United States Patent [19]

Magers et al.

[11] 4,074,861

[45] Feb. 21, 1978

[54] SPRAY PATTERN CONTROL STRUCTURE AND METHOD

[75] Inventors: Wallace F. Magers, Leawood, Kans.; James M. Jegen, Lee's Summit, Mo.

[73] Assignee: Realex Corporation, Kansas City, Mo.

[21] Appl. No.: 697,346

[22] Filed: June 18, 1976 (Under 37 CFR 1.47)

[51] Int. Cl.[2] ..... B05B 1/34

[52] U.S. Cl. ..... 239/492; 239/601

[58] Field of Search ..... 239/601, 491, 492, 493

[56] References Cited

U.S. PATENT DOCUMENTS

| | | | |
|---|---|---|---|
| 2,572,606 | 10/1951 | Fisher | 239/493 X |
| 3,072,346 | 1/1963 | Wahlin | 239/601 X |
| 3,112,074 | 11/1963 | Green | 239/493 |
| 3,595,482 | 7/1971 | Jefferson-Loveday | 239/601 X |

*Primary Examiner*—Richard A. Schacher

*Attorney, Agent, or Firm*—Schmidt, Johnson, Hovey & Williams

[57] ABSTRACT

The discharge orifice on a fine mist sprayer has a hole through which streams of liquid particles are swirled at high speeds so as to fully atomize the liquid by the time it reaches the exit end of the hole. At that location an annular launching surface for the liquid particles flares outwardly from the hole wall through a curve extending at least 90° from a tangent point on the wall. As a result of this construction, the swirling streams progressively increase in diameter as they approach the exit and encounter the flared launching surface and depart at random locations from the surface to thereby produce a spray pattern of substantially circular configuration and uniform particle distribution throughout. In the preferred embodiment, the launching surface projects outwardly beyond the face of the spray head in the nature of a rim around the orifice hole, such rim being uniformly smooth, flawless and devoid of any lines of demarcation or intersection with the wall or the outside face through a curve of at least 90°.

1 Claim, 4 Drawing Figures

SPRAY PATTERN CONTROL STRUCTURE AND METHOD

This invention relates to fine mist sprayers which are capable of achieving particle size in the neighborhood of 10 microns or less. More particularly, it relates to a specific configuration of the discharge orifice of such sprayers which will produce not only the desired minute particle size, but will also create a substantially circular spray pattern of a predetermined diameter at a preselected spraying distance while maintaining a substantially uniform distribution of particles throughout the circle.

Typical conventional sprayers have a line edge at the intersection of the orifice hole and the outer face of the sprayer head surrounding the hole. The quality of such edge, i.e., pitted, irregular or uniform, has a dramatic influence on the spray pattern that is produced by liquid particles that are propelled out of the hole under pressure and toward a selected surface. If the edge is perfectly uniform and flawless, the pattern may be close to the ideal, truly circular configuration, which is the goal of most, if not all, fine mist sprayer manufacturers. The likelihood of obtaining such a perfectly "square", flawless edge, considering the state of current plastic molding techniques, is relatively slim; but, nonetheless, the industry has heretofore always strived to achieve this type of square edge around the orifice hole.

It has now been found that in addition to the likelihood of obtaining an erratically defined spray pattern from a flawed square edge, such a configuration also tends to concentrate the particles of the spray pattern in a marginal ring around the outside of the pattern, as opposed to uniformly distributing the particles throughout the entire pattern. This is, of course, highly undesirable because the surface being sprayed is left with an uncoated or only very lightly affected area in the center of the pattern with excessive amounts around the outside of the pattern. It has been found that a chief cause of such particle concentration is the sharp corner itself which forces the particle streams which are swirling through the hole toward the exit to depart from the exit at more or less the same radial location. In other words, the particle streams are literally channeled and confined by the square edge to such an extent that they depart from the exit at substantially the same radial distance from the center line of the hole, thereby striking the sprayed surface within the same, relatively narrow annulus.

In accordance with the present invention, such channeling of the liquid particles by the edge of the orifice hole has been substantially eliminated by virtue of the fact that no edge, line of demarcation or intersection is exposed to the swirling streams of particles at the exit. Instead, a smooth, gently curved and outwardly flaring launching surface for the particles is presented at the exit so that the swirling particles may fly off such surface at radially random locations along the latter, depending upon the specific velocity of each particle, its size, its surface tension and other factors. Such random departure of the particles assures that they will be distributed more or less uniformly throughout the entire spray pattern. Best results have been obtained where the launching surface is in the form of a smooth curve generated from a tangent point on the wall of the hole through at least 90° and, preferably, even further so that the surface projects outwardly beyond the face of the head in the nature of a rim around the hole.

Accordingly, one important object of the present invention is to provide, particularly in a fine mist spraying environment, a way of obtaining a substantially circular spray pattern at a selected spraying distance along with substantially uniform particle distribution throughout the extent of the circular pattern.

As a corollary to the foregoing, it is an important object of the present invention to force the swirling streams of liquid particles to depart or be launched from the fluid exit of the orifice hole at radially random locations depending upon their own peculiar particle size, velocity, surface tension and the like, instead of departing under the channeled control of a square edge at that location.

A further important object of the present invention is to achieve the foregoing by embodying the launching surface in a rim that circumscribes the orifice hole and projects slightly outwardly from the face of the head, thereby providing for extension of the surface substantially beyond 90° from a tangent point on the wall of the orifice hole.

Figure 3:
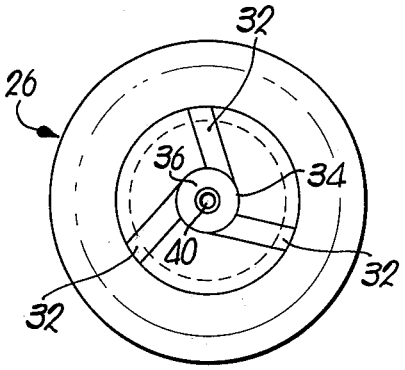
Figure 4:
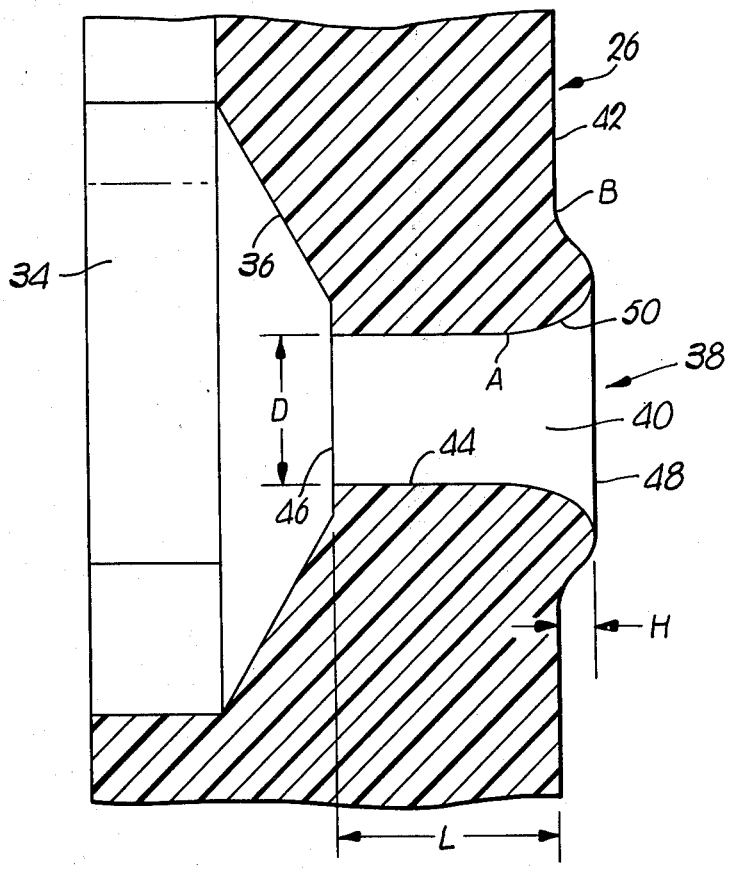

FIG. 3 is an enlarged view from inside the orifice "button" behind the orifice hole itself and illustrating the tangential channels which deliver swirling fluid into the orifice preparatory to discharge; and FIG. 4 is a greatly enlarged, fragmentary, vertical cross-sectional view through the orifice illustrating in particular the curved launching surface for the liquid particles and the relationship of such surface to other areas of the orifice.

Figure 1:
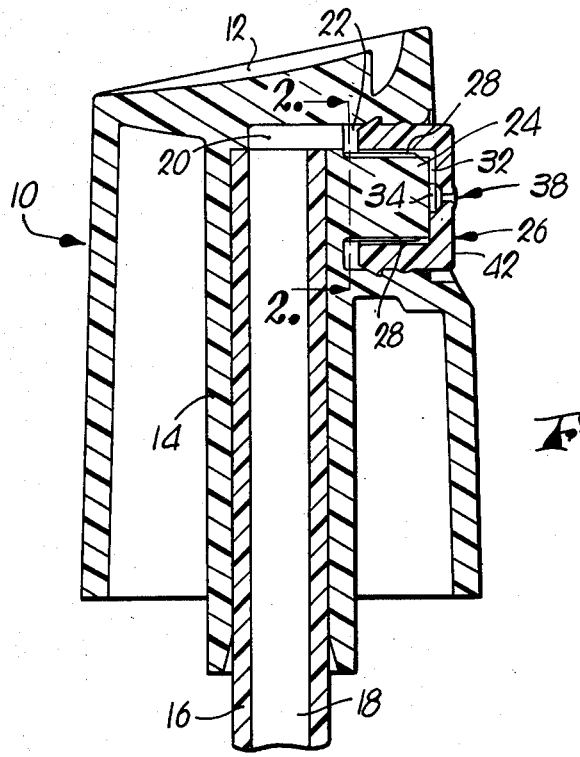
FIG. 1 is a fragmentary, vertical cross-sectional view of a sprayer head constructed in accordance with the principles of the present invention.
Figure 2:
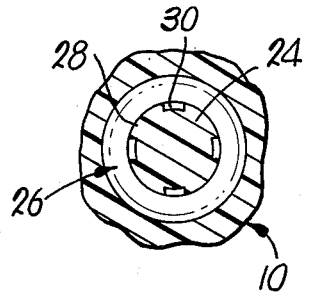
FIG. 2 is a slightly enlarged cross-sectional view through the head taken along line 2—2 of FIG. 1.

The spray head 10 has an inclined top 12 configured to complementally receive finger pressure for the purpose of depressing the head 10 to initiate spraying. An internal, normally upright sleeve 14 frictionally receives and retains a tubular plunger 16 having a fluid passage 18 that communicates at the upper end of the plunger 16 with a lateral pathway 20 in the head 10. The pathway 20, in turn, leads to an annular region 22 at the base of and surrounding a laterally projecting post 24 which is received within a cup-like member 26, hereinafter referred to as the "orifice button." Longitudinal ribs 28 on the post 24 space the periphery of the latter from the internal surface of the orifice button 26 so as to define a number of longitudinally extending areas 30 (shown best in FIG. 2) which communicate the region 22 at the base of the post 24 with three generally radially converging channels 32 at the front of the post 24 within the interior front surface of the orifice button 26.

The channels 32 converge to, and tangentially intersect, a central basin 34 having a sloping floor 36. The floor 36 opens into what is herein generically termed the orifice 38, such entity comprising a number of components and surfaces as will become apparent.

The orifice 38 includes a hole 40 that extends inwardly from the outer exposed face 42 of the button 26. The hole 40 has a continuous annular wall 44 that extends from the entrance 46 of the hole 40 toward the exit 48 thereof, such wall 44 normally being parallel to the longitudinal axis of the hole 40 but in practice perhaps tapering slightly as the entrance 46 is approached. The orifice 38 also includes an outwardly flared, annular and curved launching surface 50 that begins at point A (the termination of wall 44) and ends at point B (the intersection between surface 50 and the face 42).

In the preferred form, surface 50 defines a smooth curve generated from a tangent point at A through at least 90°, and preferably substantially more than 90°, as illustrated in FIG. 4. The surface 50 is most desirably free of flaws in the nature of cracks, ridges or pockmarks and has no discernible line of intersection or demarcation with the wall 44 at point A. Surface 50 simply blends smoothly into the wall 44 at point A.

The greater than 90° curve of the surface 50 causes the latter to present a rim-like appearance as it projects for a distance outwardly beyond the face 42. It is important to note that the entire surface of the rim thus presented is smooth and devoid of a line of intersection with the face 42, at least until the point B is reached.

The effect of this construction is as follows. When the head 10 is depressed, liquid from the plunger passage 18 is forced under pressure (either gas powered or purely manual pumping) into the coverging channels 32 which divides the body of liquid into three separate streams that swirl around the floor 36 and enter the restricted end of the hole 40 at entrance 46. Such high velocity swirling and continuous restriction into tighter and tighter regions causes the streams to atomize such that upon entering the hole 40, the streams are effectively streams of liquid particles rather than solid streams of liquid.

As the particle streams swirl along the wall 44 at relatively high pressure and velocity, they remain constantly uniform in diameter until reaching point A, whereupon they progressively grow in diameter in order to remain in contact with the outwardly flaring surface 50. Because the surface 50 does depart from the wall 44, however, the particles at some point in their respective paths of travel simply can no longer cling to the surface 50 and thereby become launched from the latter toward the surface being sprayed. Because of the various particle sizes involved and their respective individual velocities, as well as other factors, the particles depart from the surface 50 at radially random locations along the same such that they strike the sprayed surface at equally random locations, thus significantly contributing to the uniform distribution of particles throughout the spray pattern on the sprayed surface. Some of the particles may leave the surface 50 immediately upon passing point A, while others may not leave until substantially the outermost extent of the surface 50 is reached, approximately midway between point A and B. Still other particles will leave or be launched from the surface 50 at an infinite number of positions between point A and the outermost extent of the surface 50.

It has been found that best results are achieved when the surface 50 extends at least approximately 90° from point A to point B, the rim-like configuration afforded by the further extension of the surface 50 beyond 90°, as illustrated in FIG. 4, being desirable, but not absolutely necessary. In practice, and by way of example only with no intention being made here to in any respect limit the principles of the present invention, fully satisfactory results have been obtained where the diameter of the hole 40 (indicated "D" in FIG. 4) is approximately 0.009 inches, the "land thickness" between the face 42 and the entrance 46 of hole 40 (indicated by "L" in FIG. 4) is approximately 0.015 inches, and the height of the rim produced by extending the surface 50 more than 90° (denoted "H" in FIG. 4) is approximately 0.002 inches. These dimensions can, of course, vary considerably depending upon the diameter of the spray pattern desired, the particle size sought, and the nature of the liquid being sprayed. In any event, it has been found that one way of producing the orifice 38 in such a manner that it is configured in accordance with the teachings of the present invention is by utilizing a laser beam to "drill" the hole 40 and produce the smooth, rounded surface 50. When a laser beam is so used, it is directed from the outside of the button 26 inwardly with respect to the latter; or, in other words, from right to left viewing FIG. 4.

Having thus described the invention, what is claimed as new and desired to be secured by Letters Patent is:

1. In a fine mist sprayer having a discharge orifice provided with a hole, a fluid exit at one end of the hole, a fluid entrance at the opposite end of the hole, and a continuous annular wall extending between said entrance and said exit, said sprayer further having an exposed outer face departing from said exit in transverse relationship to the longitudinal axis of the orifice and means for propelling one or more swirling streams of liquid particles along said wall from the entrance toward the exit, the improvement comprising:

a uniformly smooth, flawless, annular surface flaring outwardly toward said face from said wall devoid of a line of intersection with the latter for launching the swirling particles from said wall at substantially random points along said surface, whereby to produce a substantially circular spray pattern having uniform particle distribution throughout, said launching surface defining a curve generated from a tangent point on said wall and extending through a greater than 90° arc so as to project outwardly beyond said face in the nature of a rim around said hole.

* * * * *